United States Patent [19]

Breslow et al.

[11] 3,971,557

[45] July 27, 1976

[54] CHANCE AMUSEMENT DEVICE

[75] Inventors: Jeffrey D. Breslow, Highland Park; Eugene Jaworski, Park Ridge, both of Ill.

[73] Assignee: Marvin Glass & Associates, Chicago, Ill.

[22] Filed: Mar. 13, 1975

[21] Appl. No.: 558,064

[52] U.S. Cl. ..... 273/1 E; 273/138 A

[51] Int. Cl.[2] ..... A63F 9/00

[58] Field of Search ..... 273/138 A, 138 R, 139, 273/1 E, 141 A, 143 R, 143 A, 143 B, 143 C, 143 D, 143 E, 130 R, 135 R

[56] References Cited

UNITED STATES PATENTS

| | | | |
|---|---|---|---|
| 1,569,752 | 1/1926 | Hirakawa | 273/138 R |
| 1,978,395 | 10/1934 | Groetchen | 273/143 R |
| 2,641,473 | 6/1953 | Stalter | 273/138 A |
| 2,902,283 | 9/1959 | Chalfin | 273/139 |
| 3,034,790 | 5/1962 | Breitenstein | 273/138 A UX |
| 3,399,896 | 9/1968 | Burnside | 273/138 A |
| 3,735,982 | 5/1973 | Gerfin | 273/1 E |

FOREIGN PATENTS OR APPLICATIONS

| | | | |
|---|---|---|---|
| 829,486 | 6/1938 | France | 273/1 E |
| 352,840 | 5/1922 | Germany | 273/138 A |
| 941,418 | 11/1963 | United Kingdom | 273/1 E |

*Primary Examiner*—Richard C. Pinkham
*Assistant Examiner*—Arnold W. Kramer
*Attorney, Agent, or Firm*—Coffee & Sweeney

[57] ABSTRACT

A chance operating amusement device in the form of a mechanical "shell" game, including features to permit use as a game of chance. A selectively actuatable motor driven rotary probability switch is set in motion at the beginning of each operating cycle and when released stops the probability switch in a chance position to set up a search circuit to illuminate one of a plurality of lightbulb signals. The lightbulbs each are covered by a hemispherical shell which is pivotally mounted on the housing of the device. The user then activates one of a plurality of switches which first moves a shell to uncover a respective signal light, computes a score if the signal light is illuminated, and then uncovers all of the shells for the remaining signal lights so that they all may be observed. The shells then are lowered to cover the signal lights for the beginning of the next operating cycle.

19 Claims, 9 Drawing Figures

Fig 1
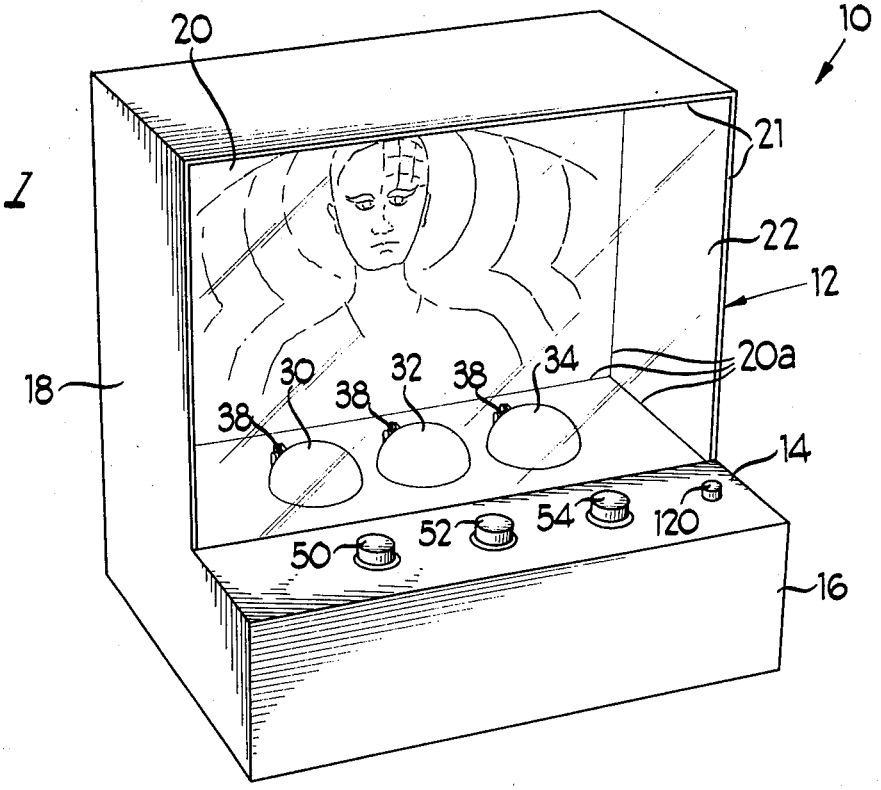
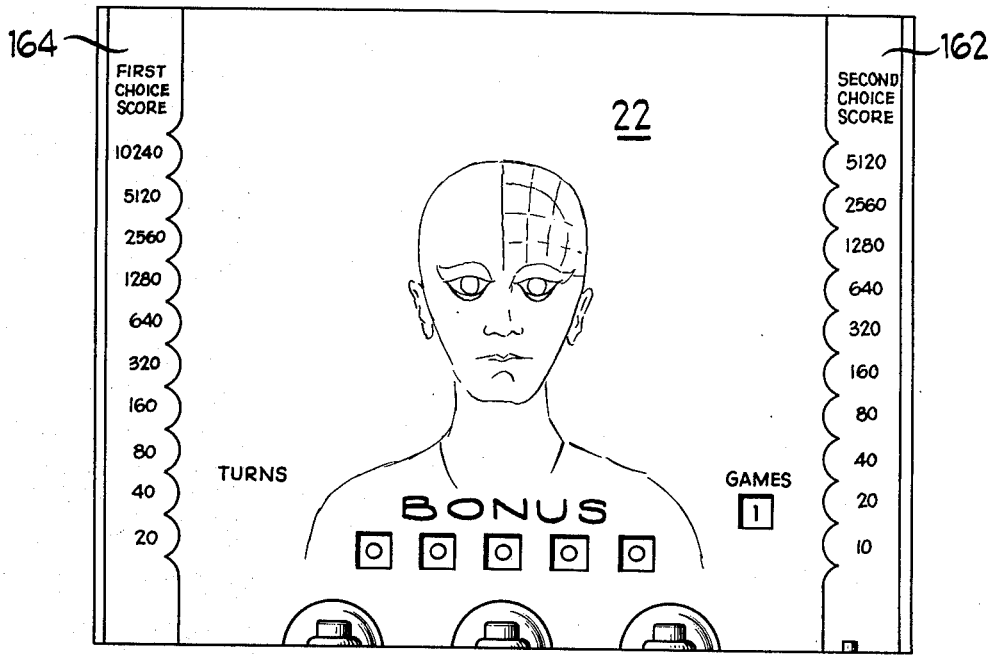
Fig 9

CHANCE AMUSEMENT DEVICE

BACKGROUND AND SUMMARY OF THE INVENTION

This invention relates to amusement devices and in particular to a device involving an element of chance.

There are many well known amusement devices which rely solely upon an element of chance. The most familiar type is the jackpot or slot machine game which often is used for chance purposes. Other types of amusement devices also have been provided which include an element of skill, such as the common pinball machine and the like.

This invention is directed, in brief, to a novel amusement device having internally actuated elements which are remotely operated by the players of the game.

An object of the present invention is to provide a novel amusement device, which can be used also for a game of chance, which requires the user to attempt to guess which one of a plurality of unobservable signal means is activated and then uncover all of the signal means and award a score to the correct guess. in particular, the amusement device is directed to an electromechanical apparatus for playing a shell game.

The best mode currently contemplated for carrying out the invention includes a housing having a base with a plurality of stations on the base. An independently actuatable signal light is mounted on the base at each station. Independently actuatable shells cover the signal lights. A motor driven rotary probability switch randomly activates one of the signal devices which are covered by the shells. A plurality of selectively actuatable uncovering devices are provided at each station to lift one of the shells to uncover the respective light which, if activated, causes a scoring means to register a score.

Other objects, features and advantages of the invention will be apparent from the following detailed description taken in connection with the accompanying drawings.

BRIEF DESCRIPTION OF THE DRAWINGS

FIG. 1 is a perspective view of the amusement device constructed according to the present invention;

FIG. 9 is an alternative embodiment for the display panel of the present invention.

DESCRIPTION OF THE PREFERRED EMBODIMENT

Figure 2:
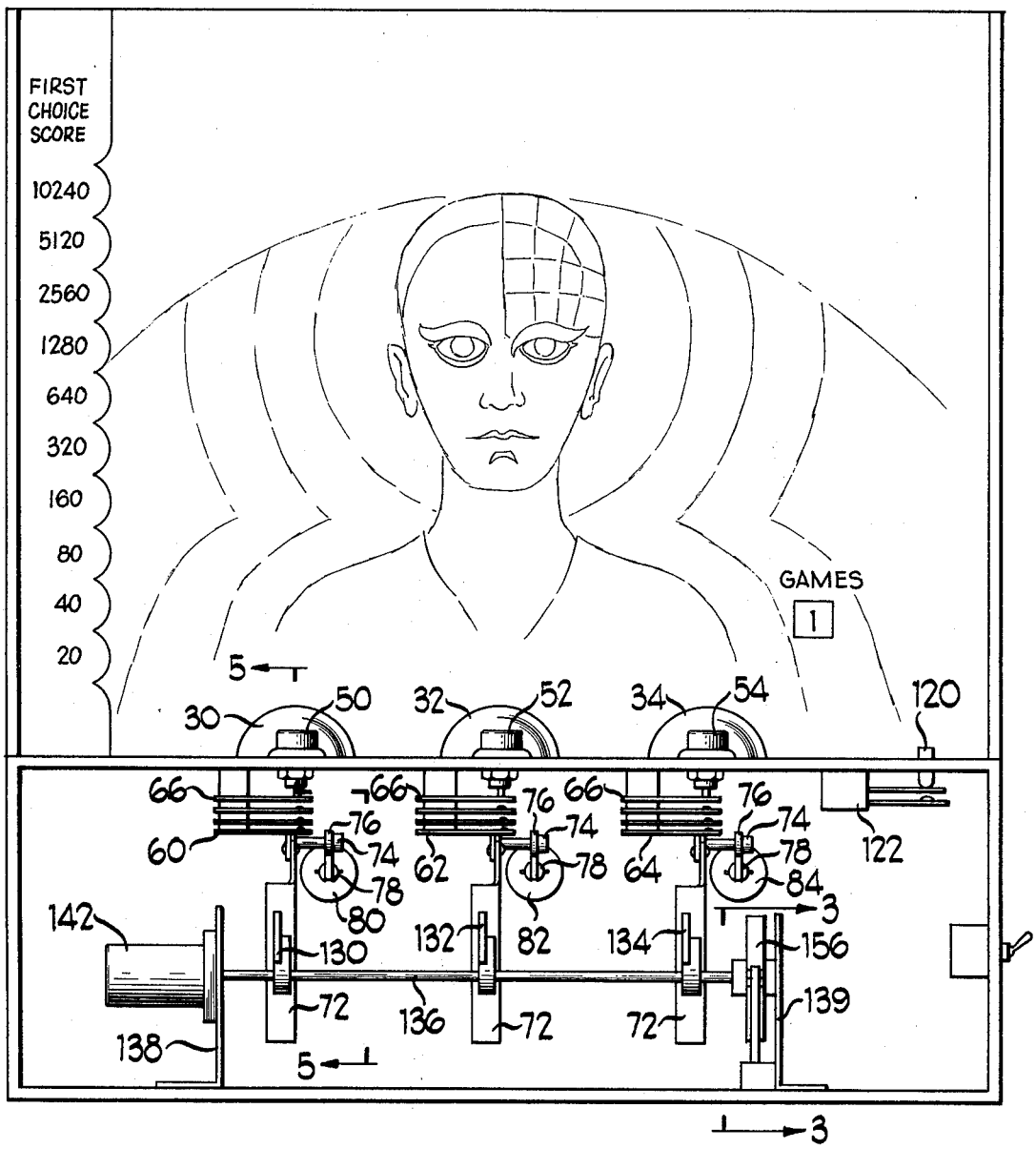
FIG. 2 is an elevational view of the amusement device shown in FIG. 1, with the front cover panel removed to show certain internal components.

FIG. 1 shows the amusement device, generally designated 10, constructed according to the present invention. The amusement device includes a housing, generally designated 12, having a horizontal base or control panel 14, a front cover panel 16, and side walls 18 which mount a generally vertical display panel 20. The display panel 20 is formed of opaque or painted plastic or glass material. The display panel 20 is set back (as seen by the edge lines 20*a*) from a front transparent wall closure (along the edge lines 21) which may be formed of glass or suitable plastic. The base or control panel 14 extends past the front panel 22 to the display panel 20.

A plurality of lights and control relays are mounted on the back of the diaplay panel 20 for indicating particular scores. The lights and relays are operated by an associated scoring mechanism 26 (FIG. 8) which also is mounted on the back of the display panel 20. The principles and operation of these relays and scoring mechanisms are generally known in the pinball art and need not be elaborated in this disclosure. Similarly, the specific construction and materials involved will depend on the particular use and performance desired.

A known motor driven rotary probability switch, generally designated 28 (FIG. 4), is mounted on the back of the display panel 20, the operation of which will be described in detail hereinafter.

The amusement device 10 of the present invention is an electro-mechanical representation of a shell game similar to that performed by magicians and other performers. In this game, the magician hides a small ball or "pea" under one of a plurality of hemispherical covers or shells. He then quickly switches them around in complete view of the audience. Thereafter, a member of the audience, or a person who is playing the game with the magician, will attempt to guess which shell is covering the pea. In the amusement device 10 of the present invention, lightbulbs are randomly lit, one at a time, and the shells or covers are pivotally mounted so they can be independently rotated to expose one of the lightbulbs.

Figure 5:
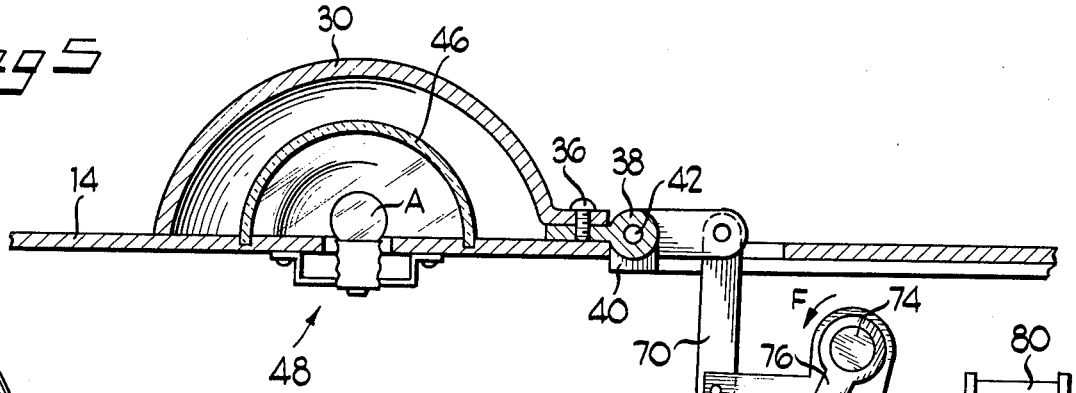
FIG. 5 is a fragmentary side elevational view, on an enlarged scale, taken generally along the line 5—5 of FIG. 2.
Figure 8:
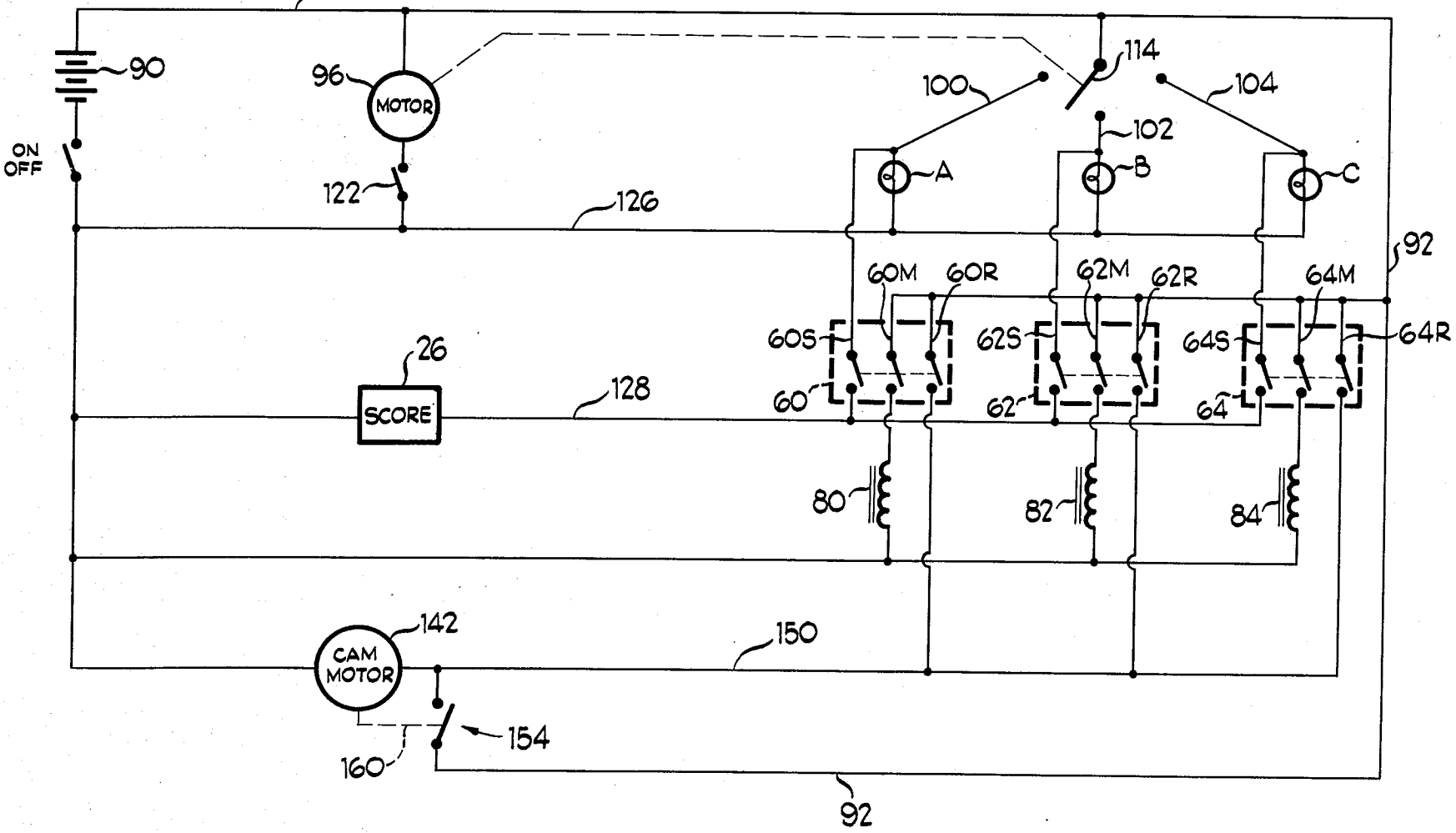
FIG. 8 is a schematic representation of the electrical components of the amusement device of the present invention.

The base or control panel 14 of the amusement device 10 includes three stations for use in operating the game. More particularly, referring to FIGS. 1, 2 and 5, three hemispherical covers or shells 30, 32 and 34 are pivotally mounted on the base 14, one at each station. The covers 30–34 are fastened by a screw or bolt 36 to a lever 38. Each of the levers 38 are pivotally mounted to the base or control platform 14 by a journal 40 and a journal pin 42. A hemispherical transparent diffuser 46 is mounted beneath each cover 30 above one of a plurality of signal means, generally designated 48. The signal means 48 may be any type of signal device having a normal deactivated state and a second activated state and as used in the present invention are lightbulbs, designated "A," "B" and "C," under the shells 30, 32 and 34 respectively (FIGS. 1, 5 and 8).

A plurality of selectively operable uncovering means are provided in the form of spring biased pushbuttons 50, 52 and 54 on the control panel 14. Each pushbutton 50–54 is associated with its adjacent shell 30–34, respectively for playing the game. The pushbuttons 50–54 each are connected to a triple throw switch, 60, 62 and 64 (FIGS. 2 and 8) which will allow the user to remotely pivot the shells 30–34 respectively, as will be described in detail hereinafter.

When the user desires to observe one of the lightbulbs A through C, he simply pushes the button associated with that lightbulb. Turning to FIGS. 2 and 8 for example, depressing button 50 will flex and make a connection between three sets of contacts of the triple throw switch 60 (FIG. 8) associated with the button 50. As seen in FIGS. 2 and 8, a similar triple throw switch 62 is associated with the pushbutton 52, and a third triple throw switch 64 is associated with the pushbutton 54. The spring biasing force of the uppermost leaf 66 of the respective switches 60, 62 and 64 maintain the buttons 50, 52 and 54 in their uppermost position.

Referring again to FIG. 5, the cover levers 38 each are pivotally connected by a link 70 to an L-shaped cam follower 72 which is pivotally mounted to the underside of the control panel 14 by a shaft 74. Each shaft 74 includes a crank arm 76 which is connected to the movable armature 78 of a solenoid 80, 82 and 84 associated with the shells 30, 32 and 34, respectively (FIGS. 2 and 8). A spring 88 is coiled about each armature 78 to maintain the solenoid armatures in their extended positions.

Referring to the electrical diagram of FIG. 8, a power source 90 in the form of a battery or wall plug is provided to energize the circuit. A power supply line 92 leads from the power source 90 to one contact 60M, 62M and 64M of the switches 60, 62 and 64, respectively. Therefore, upon closure of the respective contact 60M, 62M or 64M the corresponding solenoid 80, 82 or 84 will be actuated. Actuation of the solenoid causes the armature 78 to rotate the crank arm 76 in a counterclockwise direction, shown by arrow F in FIGS. 5 and 7, to pivot the shell upwardly to expose the diffuser 46 above the lightbulb respectively associated with that particular solenoid.

Figure 4:
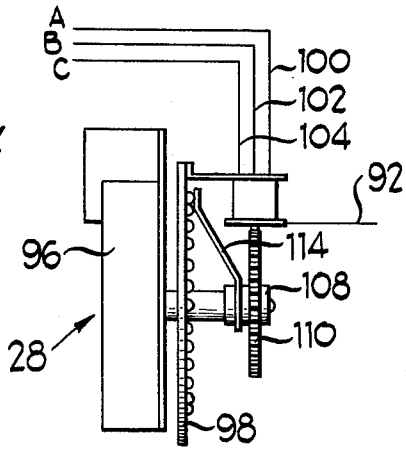
FIG. 4 is a side elevation of the motor driven rotary probability switch mounted within the housing.

Before proceeding with the description of the scoring system, the actuation of the signal means for lighting of the lightbulbs A, B and C should be described. Turning to FIG. 4, as previously mentioned, a motor driven rotary probability switch 28 is used to randomly illuminate one of the lights A, B or C. The switch 28 includes a motor 96 and a multicontact circular ring 98. The spaced contacts of the ring 98 are alternately connected to the leads 100, 102 and 104 which lead to the lightbulbs A, B and C respectively (FIGS. 4 and 8). The shaft 108 of the motor 96 includes a slip ring 110 which contacts the source lead or power line 92. A rotating contact arm 114 is mounted on a shaft 108 and rotates therewith for making electrical contact between the power line 92 and one of the plurality of contacts on the multicontact ring 98. The electrical motor 96 is shown in the electrical diagram of FIG. 8 and is connected by a dotted line, which represents the mechanical connection, to the rotary contact arm 114. The rotary contact arm 114 always is in engagement with one of the outgoing leads 100, 102 or 104. Energizing of the motor 96 is accomplished through a selectively operable pushbutton switch 120. The pushbutton switch 120 is mounted on the control panel 14 (FIGS. 1 and 2) in easy reach of the user. Depressing the switch 120 closes the contacts 122 (FIGS. 2 and 8) to energize the motor and to continue rotation. The motor will therefore continue to rotate until the user releases the pushbutton 120. When the button is released, current will flow through one of the lights A, B or C depending upon which lead 100, 102 or 104 is made. The current will return to the power source through the return lead 126.

When the user makes a choice by depressing one of the buttons 50, 52 or 54, the three sets of contacts of the associated triple throw switch will be made. If the user has correctly chosen to uncover the actuated signal or lighted bulb A, B or C, the corresponding contact 60S, 62S or 64S (FIG. 8) will be energized through the corresponding circuit to energize the scoring means 26 through the lead 128 as shown in FIG. 8. This will automatically total a score for him on the display panel 20.

If, however, the user has incorrectly chosen and opens the wrong shell 30, 32 or 34, no contact will be established through the power source to the scoring means and no score will be achieved.

As previously mentioned, after the user has chosen one of the shells to be opened, the remaining shells will automatically open to allow all of the lights or signals to be viewed. Thus, it will be possible for him to see which one of the lightbulbs is illuminated if in fact he has chosen incorrectly. If he has chosen correctly, the shells will open to also show the other players of the game that only one lightbulb has been lit.

Figure 6:
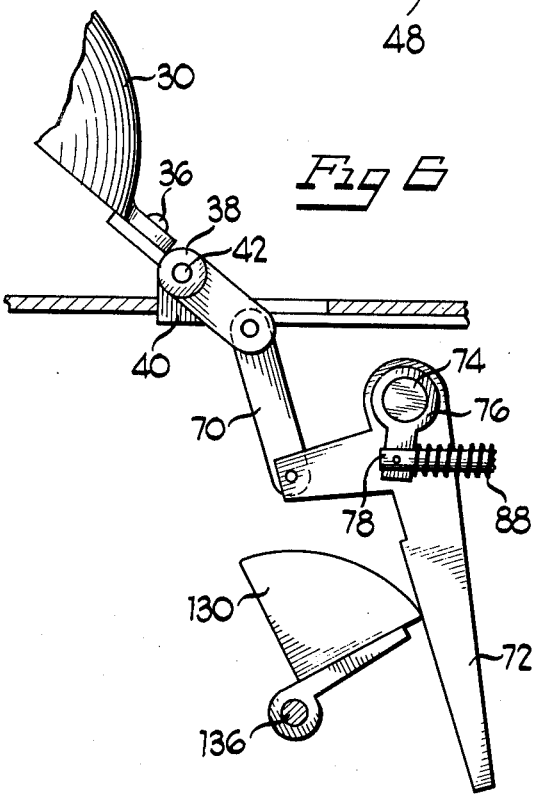
FIG. 6 is a fragmentary side elevational view similar to FIG. 5, showing the shell in a partially open position.
Figure 7:
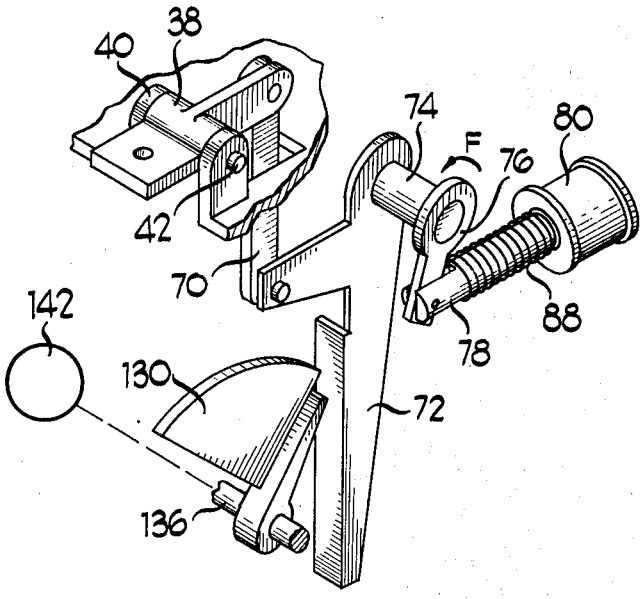
FIG. 7 is a perspective view of the shell opening mechanism.

More particularly, referring to FIGS. 2, 5 and 7, three cams 130, 132 and 134 are associated with the cam followers 72 of each shell 30, 32 and 34, respectively. The cams 130 through 134 are mounted on a shaft 136 which is rotatably mounted by two end journals 138 and 139 on the housing. A cam motor 142 (FIGS. 2 and 8) is mounted on one end of the shaft 136. When the cam motor is energized (as described below) the shaft 136 rotates and causes the cams 130–134 to engage the cam followers 72 and to thereby open the remaining closed shells 30, 32 or 34, as seen in FIG. 6. The shaft and cams continue to rotate, and after approximately 90° of rotation of the shaft the shells will be fully open. Continued rotation of the shaft 136 will slowly lower all of the shells 30–34 to their closed positions. Thus the user has had an opportunity to observe all of the signal means to see if his guess was correct or incorrect.

Figure 3:
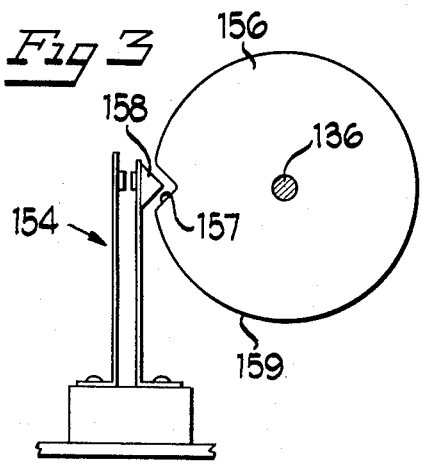
FIG. 3 is a side elevational view of the interrupter cam switch means, taken generally along the line 3—3 of FIG. 2.

The cam motor, as mentioned above, is actuated by depressing one of the buttons 50, 52 or 54 during a choice by the user. When depressing one of the aforementioned buttons, the third and final contact 60R, 62R or 64R of the triple throw switches will be closed to connect the power source line 92 to the cam motor line 150. The closing of these contacts will energize and start the cam motor rotating. When the cam motor rotates, as described above, the two remaining closed shells begin to open. Since it is desirable to permit the user to release the button 50, 52 or 54 after his choice is made, an override cam contact set, generally designated 154 (FIG. 3) is provided to continue electrical power for the cam motor. More particularly, referring to FIGS. 3 and 8, the contact 154 is connected in parallel with the power source line 92 and the cam motor input line 150. An interrupter cam 156 (FIG. 3) is mounted on the opposite end of the shaft 136 from the motor 142. Upon energizing the cam motor 142, the cam 156 will rotate and a cam following surface 158 on one of the contacts of the cam contact set 154 engages the periphery 159 of the cam 156 to close the contact 154 for continued energization of the cam motor. The cam 156 is illustrated by the dotted line 160 on the electrical diagram. Thus, immediately upon activating the cam motor by depressing one of the buttons 50, 52 or 54, the cam 156 closes the contact set 154 to maintain energization of the motor to permit one full revolution of the shaft 136. At the end of one full revolution of the cam 156 and shaft 136, the contact 154 will fall into a detent 157 in the periphery 159 of the cam and separate to deenergize the cam motor, thereby readying the amusement device for the next operating cycle.

The amusement device as just described is relatively simple in both its mechanical and electrical component construction. This enables the device to be made relatively inexpensively.

Moreover, the scoring system as described, is relatively simple and is easily adapted for greater sophistication. For example, as shown in FIG. 9, the electrical circuitry could be altered to include means to permit the user, once he has failed in his first choice, to take a second choice before all of the covers are automatically lifted. Again, this would require a relatively minor alteration in the electrical system and it is not necessary to go into its details at this point. However, in this (second choice alteration) it would be desirable to have a second choice score value less than that of a first choice score. As seen in FIG. 9, the alternate embodiment discloses a right and lefthand column 162 and 164 for totalling the correct first and second choice scores. As shown, the second choice scores are equal to one-half the value of the first choice scores. Additionally, in the center of the display panel 22, a series of five openings are provided to accumulate and display bonus points which are awarded to a user who successfully chooses the correct shell on his first choice two or three times in a row.

As can be seen, many variations and modifications can be added to the basic amusement device 10 without departing from the generally concept of the present invention. Therefore the disclosure and detailed specifications are given for clearness of understanding only and no unnecessary limitations should be understood therefrom as some modifications, such as those described, will be obvious to those skilled in the art.

We claim:

1. A game apparatus, comprising:

a base having a plurality of stations thereon;

a plurality of independently actuatable signal devices having a normal deactivated state and a second activated state mounted on said base, at least one at each station;

means to randomly activate the signal devices at only one station at a time;

a plurality of independently movable opaque covers, one at each station, for covering the signal device thereat and mounted for movement between a normal first position covering the associated signal device and a second position uncovering the associated signal device for observance by players of the game; and a plurality of selectively and independently actuatable cover moving means operable by a player of the game, one for each station and operatively associated with the cover thereat, for moving the cover from its first position to its second position to expose the signal devices thereunder.

2. The game apparatus of claim 1 including scoring means for registering a score whenever the station in which a cover moving means has been actuated has its associated signal device activated.

3. The game apparatus of claim 1 including second means to move the remaining covers from their first positions to their second positions after at least one cover moving means has been actuated to permit all of the signal devices to be simultaneously observed.

4. The game apparatus of claim 3 including means to move all of the covers back from their second positions to their first positions.

5. The game apparatus of claim 1 wherein each signal device is a lightbulb.

6. The game apparatus of claim 5 wherein said means to randomly activate the signal devices includes an electrical circuit having an electrical power source electrically connected to said lightbulbs, switch means in said circuit movable between a plurality of positions, each position connecting the power source to one of said lightbulbs, means to move said switch means between said positions, and means to randomly stop the switch means at one of said positions to actuate the lightbulb at one of said stations.

7. The game apparatus of claim 1 wherein each cover moving means includes an electrical circuit having an electrical power source connected to a solenoid, said solenoid being associated with the respective cover to move the same from its first position and its second position, and means to selectively actuate said solenoid by a player of the game.

8. The game apparatus of claim 1 including scoring means for registering a score whenever the station in which a cover moving means has been actuated has its associated signal device activated, said scoring means registering a score in response to an electrical signal, and a normally incomplete electrical circuit having an electrical power source connected to said scoring means and said cover moving means, whereby the actuation of the cover moving means having its associated signal device activated closes said incomplete circuit providing an electrical signal to said scoring means.

9. An amusement device, comprising:

a base having a plurality of stations thereon;

a plurality of independently illuminable lightbulbs mounted on said base, one at each station;

means to randomly illuminate one of said lightbulbs;

a plurality of independently movable opaque covers, one at each station, for covering the lightbulb thereat and mounted for movement between a normal first position covering the associated lightbulb and a second position uncovering the associated lightbulb for observance by players of the game;

cover moving means for each cover including an electrical circuit having an electrical power source connected to a solenoid, said solenoid being associated with the respective cover to move the same from its first position and its second position, and means to selectively actuate said solenoid by a player of the game; and scoring means for registering a score whenever the station in which a cover moving means has been actuated has its associated lightbulb illuminated.

10. The amusement device of claim 9 wherein said cover moving means includes means to move the remaining covers from their first position to their second position after one cover moving means has been actuated.

11. The amusement device of claim 10 wherein said cover moving means includes means to move all of the covers from their second position back to their first position.

12. The amusement device of claim 11 including an interrupter switch to open said circuit after all of the cover means have been moved back to their first positions to permit a player to start a new cycle of play.

13. The amusement device of claim 9 wherein said means to randomly illuminate one of said lightbulbs includes an electrical circuit having an electrical power source electrically connected to said lightbulbs, switch means in said circuit movable between a plurality of positions, each position connecting the power source to one of said lightbulbs, means to move said switch means between said positions, and means to randomly stop the switch means at one of said positions to actuate the lightbulb at one of said stations.

14. The amusement device of claim 9 including scoring means for registering a score whenever the station in which a cover moving means has been actuated has its associated lightbulb illuminated, said scoring means registering a score in response to an electrical signal, and a normally incomplete electrical circuit having an electrical power source connected to said scoring means and said cover moving means, whereby the actuation of the cover moving means having its associated lightbulb illuminated closes said incomplete circuit providing an electrical signal to said scoring means.

15. A chance amusement device, comprising:

a base having a plurality of stations thereon;

a plurality of independently illuminatable lightbulbs mounted on said base, one at each station;

a plurality of independently movable opaque covers, one at each station, for covering the lightbulbs thereat and mounted on the base for movement between a normal first position covering the associated lightbulb and a second position uncovering the associated lightbulb for observance by players of the game;

random means to randomly illuminate one of said lightbulbs, including an electrical circuit having an electrical power source connected to the lightbulbs, first random switch means in said circuit movable between a plurality of positions, each position connecting the power source to one of said lightbulbs, and second switch means selectively actuatable by a player of the game to move said first switch means on actuating said second switch means and to stop said first switch means on releasing said second switch means to randomly illuminate one of said lightbulbs; and cover moving means actuatable by a player of the game for selectively and independently moving one of said covers from its first position to its second position to expose the lightbulb thereunder, then to automatically move the remaining covers from their first position to their second position to expose all of the lightbulbs, and then automatically move all of the covers from their second position back to their first position for the start of another play of the game.

16. The amusement device of claim 15 including scoring means in said electrical circuit for registering a score whenever the player selected cover has been actuated at a station where the respective lightbulb has been illuminated.

17. The amusement device of claim 16 including a normally incomplete electrical circuit having an electrical power source connected to said scoring means and said cover moving means, whereby the actuation of the cover moving means by a player actuating the cover and having its associated lightbulb illuminated closes said incomplete circuit providing an electrical signal to said scoring means.

18. The amusement device of claim 15 wherein said cover moving means includes for each cover an electrical circuit having an electrical power source connected to a solenoid, said solenoid being associated with the respective cover to move the same from its first position and its second position, and means to selectively actuate any of said solenoids by a player of the game.

19. The amusement device of claim 15 including an interrupter switch to open said circuit after all of the cover means have been moved back to their first positions to permit a player to start a new cycle of play by again actuating said second switch means.

* * * * *